United States Patent [19]

Sefton

[11] 4,327,453

[45] May 4, 1982

[54] HOSPITAL PATIENT TRANSFER UNIT

[76] Inventor: Francis Sefton, 116 Providence Rd., Grafton, Mass. 01519

[21] Appl. No.: 154,586

[22] Filed: May 29, 1980

[51] Int. Cl.[3] ..... A61G 7/10

[52] U.S. Cl. ..... 5/81 R; 5/63; 5/81 B

[58] Field of Search ..... 5/81 R, 81 B, 60, 63, 5/65, 83

[56] References Cited

U.S. PATENT DOCUMENTS

| | | | |
|---|---|---|---|
| 2,208,410 | 7/1940 | Carter | 5/81 B |
| 2,272,778 | 2/1942 | Reuter | 5/81 B |
| 3,815,164 | 6/1974 | Smith | 5/81 R |
| 3,886,605 | 6/1975 | Harris | 5/81 R |
| 3,924,281 | 12/1975 | Gibbs | 5/81 R |
| 4,012,799 | 3/1977 | Rutherford | 5/81 R |
| 4,156,946 | 6/1979 | Attenburrow | 5/81 R |
| 4,195,375 | 4/1980 | Paul | 5/81 R |

OTHER PUBLICATIONS

"Surgilift the Most Efficient, Economical Addition You Can Make To Your Staff", Brochure of Institutional Industries, 5500 Muddy Creek Rd., Cincinnati, Ohio, (1970), 6 pages.

"The Tabbert Story", Brochure of Cambridge Scientific Industries, Cambridge, Maryland, (undated).

"Now Move Him Without Moving Him", Brochure of Mobilizer Medical Products, Inc., Summit, New Jersey, (Jul. 1975).

*Primary Examiner*—Stephen J. Novosad

*Attorney, Agent, or Firm*—Blodgett & Blodgett

[57] ABSTRACT

A device for lifting a patient from his hospital bed and placing the patient on a wheeled transfer unit. The patient's bed sheet is used as the principle lifting medium. The transfer unit can be loaded and unloaded from either side. The operation can be performed by one person. Support arms are extended from the stretcher to the patient lying in bed. The arms support clamping bars which are capable of securely grasping the patient's bed sheet.

11 Claims, 26 Drawing Figures

HOSPITAL PATIENT TRANSFER UNIT

BACKGROUND OF THE INVENTION

The conventional method of moving patients from their hospital bed to a wheeled stretcher or transfer unit and vice versa is to assemble a group of 4 to 6 orderlies and nurses and have them physically manipulate the patient from the bed to the stretcher. This operation must be duplicated with a new group of people when the patient is conveyed from the stretcher to a treatment table, for example, in X-ray procedures. This approach is not only extremely wasteful of the limited human resources available in the hospital and extremely disruptive of their other duties, but can be dangerous to the hospital personnel who must perform the awkward lifting operations and to the patient who may not be able to tolerate the twisting and jerking which would normally accompany the procedure.

Although there have been many attempts to mechanize this transfer operation, all have suffered from one or more major shortcomings. In particular, several of the devices use a lifting web which must be slid under the patient. This operation can be somewhat difficult for one person to accomplish and can be extremely painful for patients in delicate condition. Furthermore, many devices can only be unloaded on the same side as they are loaded. Since the most convenient side of the bed for loading may not be the same side as for unloading at the treatment table, either the hospital furniture must be moved around or the patient must be manipulated around on the stretcher. Either solution nullifies much of the value of the lifting device.

It is, therefore, an outstanding object of the invention to provide a mechanical lifting system adapted to transfer a patient from his hospital bed to a wheeled transfer unit.

Another object of this invention is the provision of a lifting device which can be operated by a single individual and which does not require any physical lifting by the operator.

A further object of the present invention is the provision of a lifting system which utilizes the patient's bed sheet as the lifting medium.

It is another object of the instant invention to provide a lifting system with which the transfer unit can be unloaded from the side opposite that at which it was loaded.

A still further object of the invention is the provision of a transfer unit which is simple to operate, relatively inexpensive to manufacture, and which is capable of a long and useful life with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a wheeled transfer unit for transferring a patient lying on a sheet to and from a bed or the like. The unit has a frame, a generally rectangular horizontal supporting member, and a lifting means mounted on the frame for clamping opposite ends of the sheet on which a patient is lying and for lifting and lowering the sheet with the patient supported thereon to and from a level above the supporting member. The said lifting means is also effective for extending the sheet-supported patient laterally of the supporting surface between a position where the patient is completely out of vertical alignment with the supporting member and a position where the patient is directly above the supporting member.

More specifically, the transfer unit has an elongated support arm at each end of the supporting surface of the lifting means, and means is provided for mounting each support arm on the frame for movement along its longitudinal axis between a first position where the arm lies along the end edge of the supporting surface and a second position where the arm extends laterally of the supporting surface, said arm being mounted for vertical movement between the level of the supporting table to a level above the supporting table.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
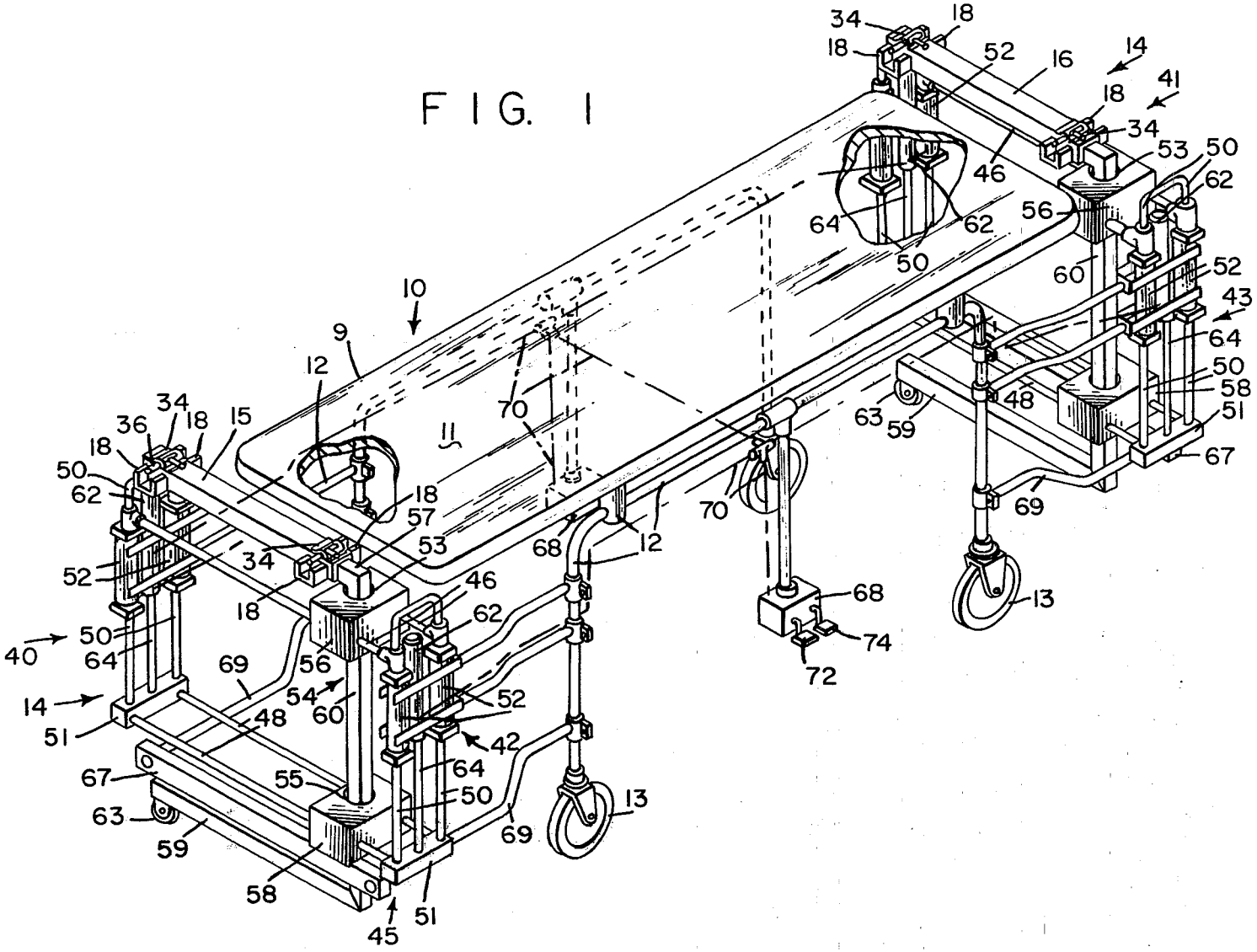
FIG. 1 is a perspective view of a transfer unit incorporating the principles of the present invention.
Figure 2:
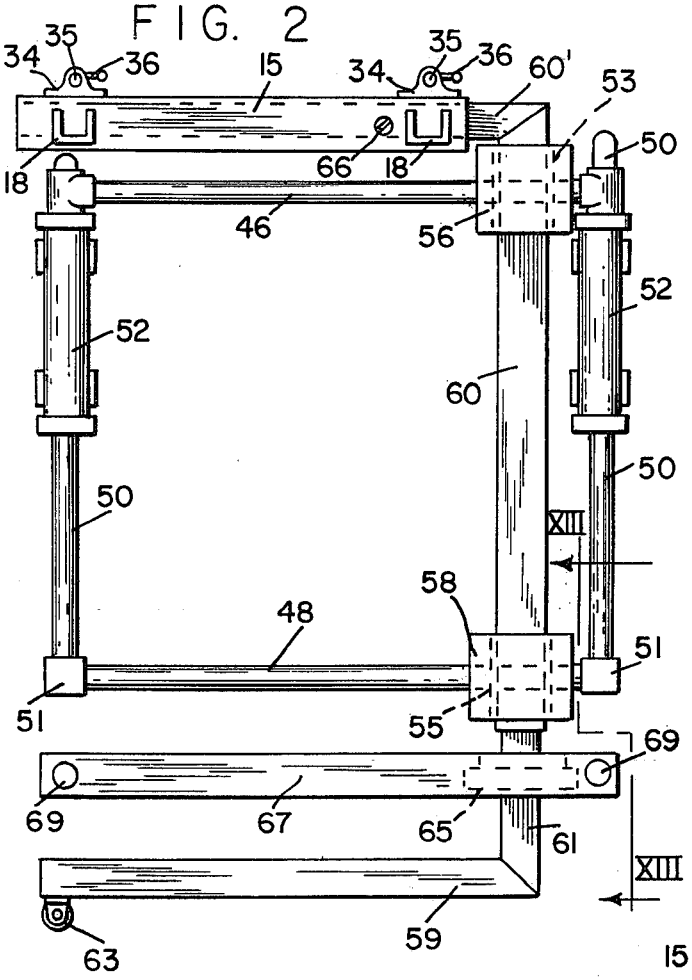
FIG. 2 is an end elevational view of the unit looking in the direction of arrow II of FIG. 1, FIGS. 3*a* and 3*b* show a patient on a hospital bed and transfer unit in front elevational and plan view, respectively.
Figure 13:
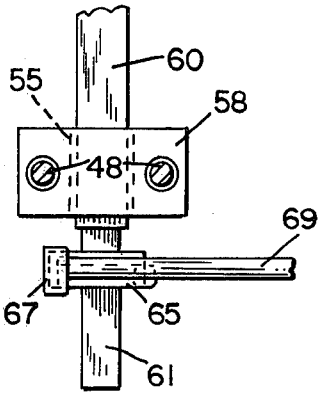
FIG. 13 is a vertical sectional view of the unit taken along line XIII—XIII of FIG. 2 and looking in the direction of the arrows.

Referring particularly to FIGS. 1, 2 and 13, the transfer unit, indicated generally by the reference numeral 10, consists of a supporting table 9 mounted on a frame 12 provided with supporting caster wheels 13. Table 9 has a flat supporting surface 11. The transfer unit 10 is also provided with lifting means, generally indicated by the reference numeral 14, mounted on the frame 12 and having support arms 15 and 16 located at opposite ends of the supporting table. The ends of the support arms 15 and 16 are provided with laterally-extending U-shaped brackets 18 for supporting elongated clamping arms 19 and 20, respectively. The arms 19 and 20 form with the support arms 15 and 16 a generally rectangular horizontal frame, as shown, for example, in FIG. 3*b*. Arms 19 and 20 are identical, arm 19 being shown in greater detail in FIGS. 14 and 15.

Figure 14:
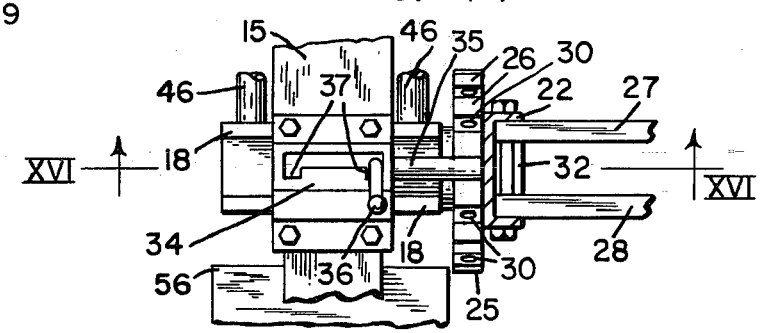
FIG. 14 is a fragmentary plan view of one end of the clamping arm mounted on the support arm and showing means for locking the clamping arm in place.
Figure 15:
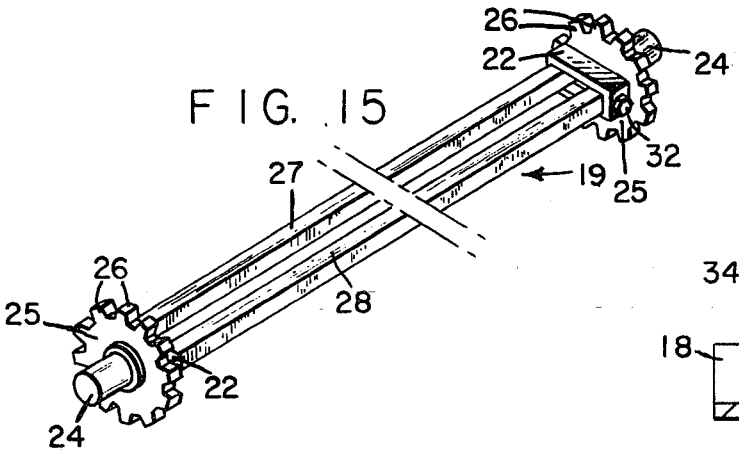
FIG. 15 is a perspective view of an elongated clamping arm.

Referring particularly to FIGS. 14 and 15, the clamping arm 19 comprises a housing consisting of two rectangular brackets 22 for supporting a pair of elongated pinch bars 27 and 28 therebetween. A toothed disc 25 with a spindle 24 is attached to each bracket 22. Bracket 22 is shown in section in FIG. 14 to illustrate the manner in which pinch bars 27 and 28 are mounted in the brackets for movement toward and away from each other. A supporting pin 32 extends freely through the pinch bars 27 and 28 so that the pinch bars can be moved toward and away from each other.

Clamping arms 19 and 20 are mounted on support arms 15 and 16 by placing spindles 24 within oppositely facing U-shaped brackets 18, whereby the clamping arms may be freely rotated. The clamping arms 19 and 20 are maintained in a particular position by latching means 34 mounted on each end of each support arm. Each latching means 34 includes a sliding bolt 35 slidable transversely to the plane of the disc 25 and in line with the spaces between the teeth 26 of disc 25. A latch handle 36 is connected to bolt 35 for sliding the bolt.

During use of the invention for transferring patients, the opposite edges of the bed sheet are clamped between the pinch bars 27 and 28 of the clamping arms 19 and 20 by drawing the pinch bars together. As shown in FIG. 14, each disc 25 is provided with holes 30 located between the teeth 26. The clamping arms 19 and 20 are then rotated by inserting a pin or other suitable implement into one of the holes 30 and used as a lever for providing a partial rotation of the clamping bar. The pin is then removed and inserted into a second hole 30, whereupon the disc 25 is given another partial rotation. This procedure is continued until the sheet is wrapped about both clamping arms for a number of wraps sufficient to securely support the sheet between the clamping arms. At this point, bolts 36 are inserted into the spaces between teeth 26 to lock the disc 25 against rotation, as shown in FIG. 14. Each latch 34 is provided with a pair of notches 37 for receiving latch handle 36 to prevent bolt 35 from moving axially after it is in the locking position.

Again referring to FIGS. 1 and 2, support arms 15 and 16 and clamping arms 19 and 20 form part of a lifting means which also includes mounting means 40 and 41 for arms 15 and 16, respectively, and actuating means 42 and 43 for arms 15 and 16, respectively. Mounting means 40 is identical to mounting means 41 and actuating means 42 is identical to actuating means 43. Comparable elements of means 41 and 43 are given the same reference numerals as means 40 and 42, respectively.

Mounting means 40 includes a primary carriage 45 consisting of a lower pair of horizontal guide rails 48 supported by two pairs of vertical rods 50 slidably mounted within guide bearings 52. Rods 50 and rails 48 are attached by connecting blocks 51. Mounting means 40 also includes a secondary carriage 54 consisting of a lower block 58 slidably mounted on lower guide rails 48 and a vertical tubular sleeve 60. Sleeve 60 extends through a round hole 55 in block 58 and is slidingly mounted on a vertical post 61. Sleeve 60 extends through a round hole 53 in upper block 56. The top of sleeve 60 has an upper horizontal extending portion 60'. Support arm 15 is slidingly mounted on portion 60' to vary the effective length of the arm. A set screw 66 locks arm 15 to extending portion 60' in any desired position.

The lower end of vertical post 61 has a lower horizontal extending portion 59 provided with a small caster wheel 63 at its extreme end. The lower portion of post 61 extends through a bearing unit 65 at a point between block 58 and extending portion 59. Bearing member 65 is slidingly mounted within a horizontal channel member 67 attached to the frame 12 by means of connectors 69.

Figure 16:
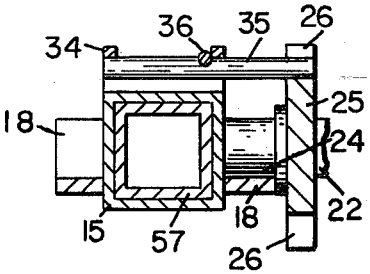
FIG. 16 is a vertical sectional view taken along the line XVI—XVI of FIG. 14.
Figure 4A:
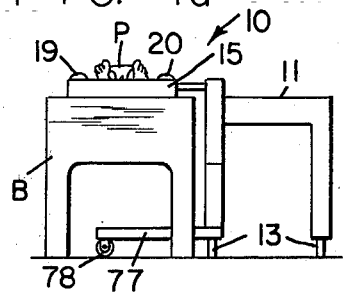
FIGS. 4*a* and 4*b* show the lifting device extended around the patient and grasping the patient's bed sheet, in front elevation and plan view, respectively.

Block 56 is slidingly mounted on a pair of upper horizontal guide rails 46 that are supported from the top of guide bearings 52, which are, in turn, supported by the frame 12. By sliding blocks 56 and 58 on guide rails 46 and 48, respectively, post 61 (together with sleeve 60) are moved from the right-hand position shown in FIG. 2 to the extreme left of the guide rails as shown in FIG. 4*a*. Sleeve 60 is located centrally within holes 53 and 55 of blocks 56 and 58, respectively, so that the sleeve 60 can be rotated about its central longitudinal axis within blocks 56 and 58 as shown for example in FIG. 8*b*. However, sleeve 60 and block 58 and 56 move vertically together. Sleeve 60 and post 61 have a square cross-section so that they rotate together. Bearing member 65 allows post 61 to rotate with sleeve 60. Extending portion 57 and arm 15 also have a square cross-section as shown in FIGS. 1 and 16.

Referring to FIGS. 1 and 2, actuating means 42 consists of a hydraulic cylinder 62 supported by the frame 12 and located between each pair of guide bearings 52. Piston rods 64 extend from pistons (not shown) in cylinders 62 and are connected to connecting blocks 51. Actuation of cylinder 62 to draw piston rods 64 into the cylinders causes the primary carriage 45 at each end of the transfer unit, together with arms 15 and 16, to be lifted from the lower position shown in FIG. 1 to the upper position shown in FIG. 6*a*.

Figure 6A:
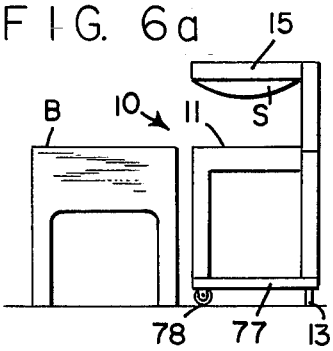
FIGS. 6*a* and 6*b* show the patient being lowered onto the transfer unit in front elevation and plan view, respectively.
Figure 7A:
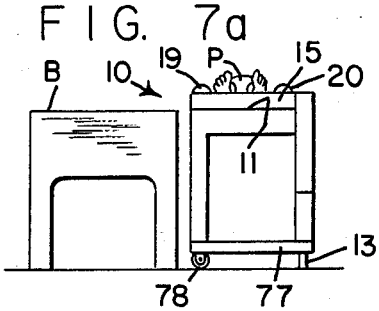
FIGS. 7*a* and 7*b* show the patient resting on the transfer unit in front elevation and plan view, respectively.

Hydraulic cylinders 62 of actuating means 42 and 43 are connected to a hydraulic control unit 68 by means of a plurality of hydraulic lines 70. Control unit 68 contains a resevoir of fluid and is provided with a pump pedal 72 and a release pedal 74. Pedals 72 and 74 are foot-actuated and are connected to appropriate valves within the control unit. Control unit 68 functions in a manner similar to a hydraulic jack in which the pump pedal 72 functions in the same manner as the crank arm of a hydraulic jack for pumping hydraulic fluid from the resevoir in the unit 68 to the cylinders 62. The hydraulic lines 70 are connected to the lower ends of cylinders 62 so that the pumping of hydraulic fluid into the cylinders causes their pistons and rods to be driven upwardly, thereby lifting rails 48, block 58 and sleeve 60 of mounting means 41 and 42. This raises arms 15 and 16 from a lower position at approximately the top of supporting surface 11 (as shown in FIG. 1) to an upper position above the supporting surface (as shown in FIG. 6*a*). Arms 15 and 16 are lowered by depressing pedal 74 which functions as a release lever, allowing fluid to flow from cylinders 62 to the resevoir in the control unit 68. A similar hydraulic unit is located on the opposite side of transfer unit 10 and the control units are hydraulically inter-connected so that the lifting apparatus can be operated from either side of the transfer unit.

Arms 15 and 16 can be moved laterally of the supporting table by sliding upper blocks 56 and lower blocks 58 on rails 46 and 48, respectively. Arms 15 and 16 can be moved from a first position at the top of flat surface 11 along the edges of the surface to a second position at the same level and to one side of the flat surface 11, as shown, for example, in FIGS. 4*a* and 4*b*. Arms 15 and 16 can also occupy a third position directly above the second position by raising the primary carriage 45 through the actuation of hydraulic cylinders 62 as previously described. This position is shown, for example, in FIGS. 5*a* and 5*b*. Finally, the arms 15 and 16 and occupy a fourth position at the higher level directly above the first position by sliding secondary carriage 54 relative to the primary carriage 45 to the original relative position shown in FIG. 1. The fourth position of arms 15 and 16 is shown in FIGS. 6*a* and 6*b*. Preferably, wheels 63 do not touch the floor except when the lifting unit is used for lifting or supporting a patient. When this happens, the weight of the patient on the cantilevered arms 15 and 16 acts through the primary and secondary carriages to force wheels 63 against the floor wherein they provide additional support for the lifting assembly.

The operation and advantages of the present invention will now be readily understood in view of the above description. Referring to FIGS. 3*a*–12*a* and 3*b*–12*b*, respectively, show the steps of transferring a patient from one supporting surface such as a hospital bed to a second supporting surface such as an examining table by means of a transfer unit 10 are clearly illustrated.

Figure 3A:
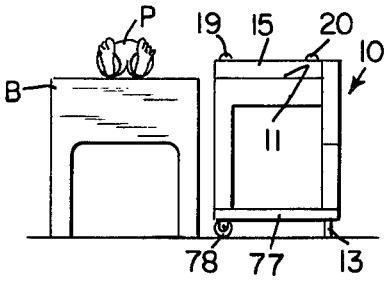
Figure 3B:
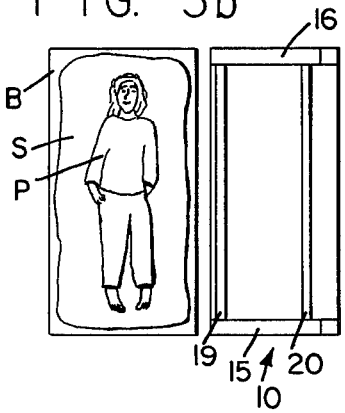

Referring particularly to FIGS. 3*a* and 3*b*, the patient P to be moved is shown lying on a hospital sheet S of a hospital bed B. The transfer unit 10 is positioned along one side of the bed B with support arms 15 and 16 in the first position.

Figure 4B:
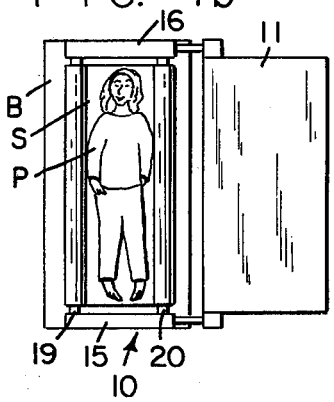

After the transfer unit 10 has been properly positioned along side of the bed, clamping arms 19 and 20 are temporarily removed from arms 15 and 16 and arms 15 and 16 are moved from the first position shown in FIGS. 3*a* and 3*b* to the second position shown in FIGS. 4*a* and 4*b*. In this position, the patient P lies between arms 15 and 16. Clamping arms 19 and 20 are then placed in supporting position between the supporting arms so that they extend along the sides of the patient and together with arms 15 and 16 form a rectangular frame completely surrounding the patient. After clamping arms 19 and 20 are in place, the pinch bars 27 and 28 of each clamping arm are drawn together to pinch the edges of the sheet and the clamping arms are rotated to accumulate a sufficient number of wraps of the sheet about the clamping arms so as to securely grasp both sides of the sheet. At this point, clamping arms 19 and 20 are locked against sliding bolts 35 of latching means 34 between teeth 26, as shown in FIGS. 14 and 16.

Figure 5A:
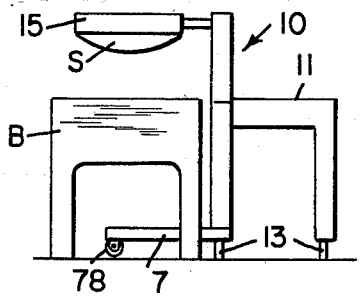
FIGS. 5*a* and 5*b* show the patient being lifted by the lifting device in front elevation and plan view, respectively.
Figure 5B:
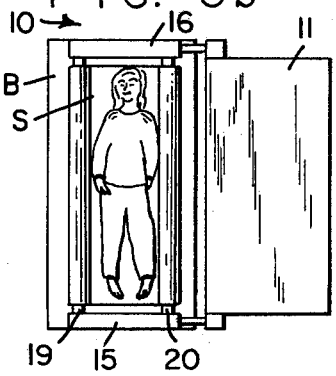
Figure 6B:
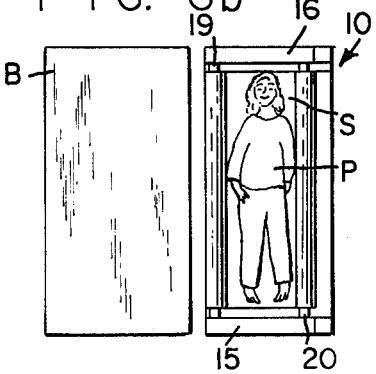
Figure 7B:
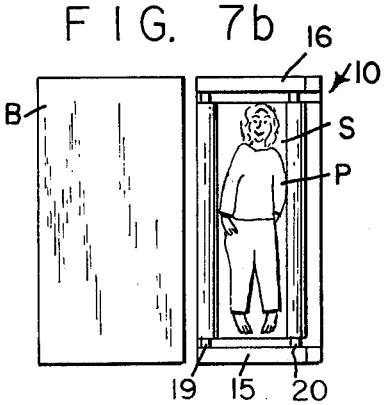

Once that the sides of the sheet are securely held by the clamping arms 19 and 20, arms 15 and 16 are raised to the third position above the hospital bed, thereby lifting the patient from the bed, as shown in FIGS. 5*a* and 5*b*. In this position, the patient is fully supported by the sheet.

Figure 8A:
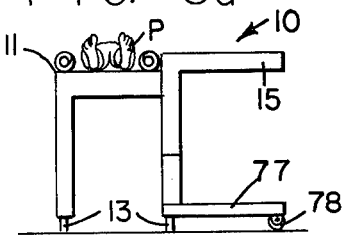
FIGS. 8*a* and 8*b* show the patient resting on the transfer unit and released from the lifting device, with the arms of the lifting device rotated so that they extend in a direction opposite to their original direction, in front elevation and plan view, respectively.
Figure 9A:
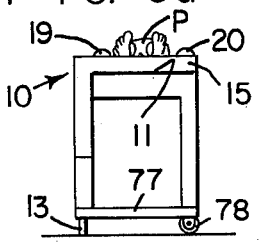
FIGS. 9*a* and 9*b* show the patient resting on the transfer unit with the lifting device retracted, in front elevation and plan view, respectively.
Figure 8B:
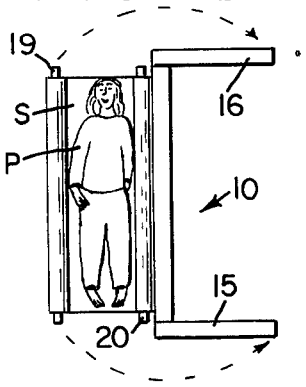
Figure 9B:
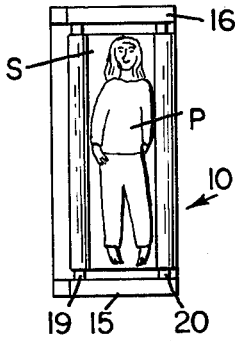

The patient P, fully supported on sheet S grasped by clamping arms 19 and 20, is moved from the third position shown in FIGS. 5*a* and 5*b* to the fourth position shown in FIGS. 6*a* and 6*b* by moving arms 15 and 16 to the fourth position above the supporting surface 11. Arms 15 and 16 are then lowered from the fourth position (shown in FIGS. 6*a* and 6*b*) back to the first position (shown in FIGS. 7*a* and 7*b*) so that the patient P, still lying on sheet S, is now supported on the supporting surface 11. The patient may now be transported to a second location and moved to another bed, operating table, or an examining table. If the orientation of the new supporting medium is similar to that of the bed from which the patient was removed, the patient will be delivered to this medium from the same side of the transfer unit 10 from which the patient was received. In this case the patient will be transferred from the transfer unit 10 to the new supporting medium by reversing the procedure previously described. However, in many cases the new supporting medium is located in a room in such a way that the patient cannot be transferred from the transfer unit 10 from the same side at which the patient was delivered. In such a case, bolts 35 are slid out of engagement with teeth 26 and arms 15 and 16 are rotated 180°, as shown in FIGS. 8*a* and 8*b*. This effectively places arms 15 and 16 in the second position relative to the supporting surface 11, whereupon arms 15 and 16 are moved back to the first position by sliding secondary carriages 54 relative to the primary carriages 45. In doing this, clamping arms 19 and 20 are raised slightly to allow arms 15 and 16 to slide beneath them, whereupon the spindles 24 at the end of clamping bars 19 and 20 are inserted within the U-shaped bracket 18 on the opposite side of arms 15 and 16. After the clamping arms 19 and 20 are properly positioned (as shown in FIGS. 9*a* and 9*b*) bolts 35 are slid into locking position between teeth 26 of discs 25, to lock clamping arms 19 and 20 in position.

Figure 10A:
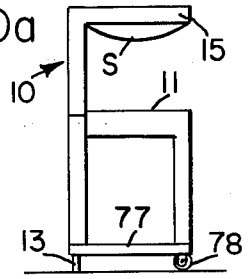
FIGS. 10*a* and 10*b* show the lifting device lifting the patient from the transfer unit, in front elevation and plan view, respectively.
Figure 10B:
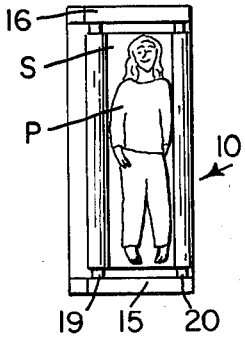
Figure 11A:
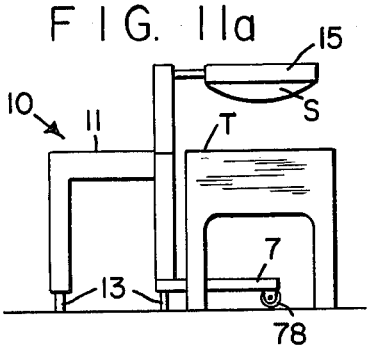
FIGS. 11*a* and 11*b* show the patient being unloaded from the transfer unit to a treatment table, the unloading occurring on the opposite side of the stretcher from the side of the stretcher on which loading occurred, in front elevation and plan view, respectively.
Figure 12A:
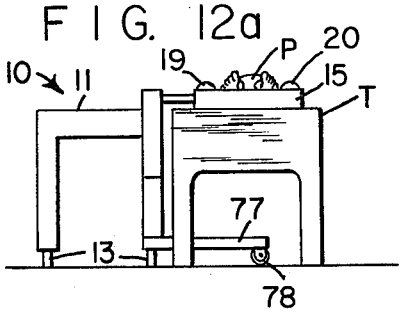
FIGS. 12*a* and 12*b* show the patient deposited on the treatment table, in front elevation and plan view, respectively.
Figure 11B:
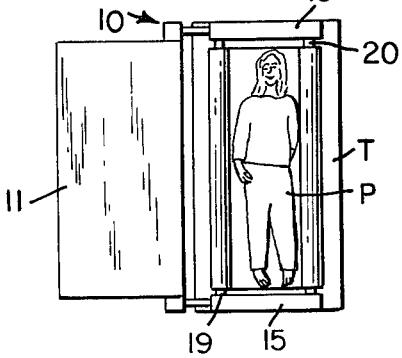
Figure 12B:
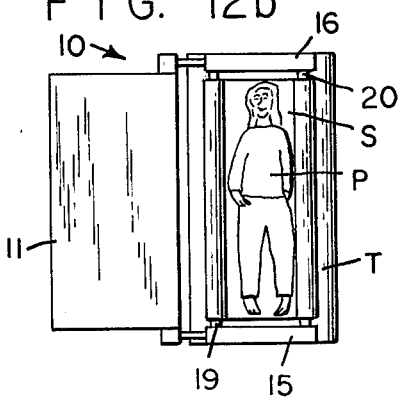

As shown in FIGS. 10*a* and 10*b*, the patient is lifted from supporting surface 11 by moving arms 15 and 16 to the fourth position. The arms 15 and 16 are then moved to their third position above the new supporting medium such as an examining table T (as shown in FIGS. 11*a* and 11*b*). Finally, arms 15 and 16 are lowered to their second position to the top surface of table T (as shown in FIGS. 12*a* and 12*b*) so that the patient, still lying on the sheet S, is supported by the table T. The sheet S is released from clamping bars 19 and 20 and the transfer unit 10 is removed from the table to be used for transferring another patient P or used at a later time for transferring patient P from table T back to the bed B.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Hospital patient transfer unit, comprising:

(a) a wheeled frame, (b) a generally rectangular table mounted on the frame and having an upper horizontal supporting surface, (c) an elongated support arm mounted on the frame at each end edge of the table, each arm being mounted for swinging movement about a vertical axis through one end thereof, the axis being movable along the end edge of the table, the arm also being movable vertically from a first position on a level with the supporting surface to a second position substantially above the supporting surface, and (d) a pair of sheet-clamping bars removably mounted on the arms and extending between them parallel to the side edges of the table.

2. A wheeled transfer unit for transferring a patient lying on a sheet to and from a bed or the like, the unit including a frame, a generally rectangular table having an upper horizontal supporting surface, and lifting means mounted on the frame for clamping opposite ends of the sheet on which a patient is lying and for lifting and lowering the sheet with the patient supported thereon to and from a level above the supporting table, said lifting means also being effective for extending the sheet-supported patient laterally of the supporting table between a position in which the patient is completely out of vertical alignment with the supporting table and a position in which the patient is directly above the supporting table, comprising (a) an elongated support arm at each end of the supporting table, (b) means for mounting each support arm on the frame for movement longitudinally between a first position where the arm lies along the end edge of the supporting table and a second position where the arm entends laterally of the supporting table, said arm being mounted for vertical movement between the level of the supporting surface to a level above the supporting surface where the arm is capable of occupying a third position above and in vertical alignment with said second position, and a fourth position above and in vertical alignment with said first position, (c) actuating means for providing said vertical movement to the supporting arms, and (d) a pair of elongated clamping arms removably supported on the ends of the support arms to form a generally rectangular carrying frame with the support arms, said clamping arms being provided with means for clamping the opposite edges of the sheet.

3. A wheeled transfer unit as recited in claim 2, wherein the means for mounting each support arm to the frame comprises:

(a) a primary carriage supported on the frame for vertical movement relative to the frame, and (b) a secondary carriage mounted on the primary carriage for vertical movement with the primary carriage and for horizontal movement relative to the primary carriage, and for supporting one end of the support arm in cantilever fashion.

4. A wheeled transfer unit as recited in claim 3, wherein the support arm is supported on the secondary carriage for rotational movement in a horizontal plane.

5. A wheeled transfer unit as recited in claim 3, wherein the actuating means is a hydraulic actuator comprising:

(a) a cylinder attached to the frame, (b) a piston slidably mounted in the said cylinder, and (c) a connecting rod, one end of which is connected to the piston and the other end of which is connected to the primary carriage.

6. A wheeled transfer unit as recited in claim 5, wherein the hydraulic actuator comprises a foot actuated control unit pneumatically connected to the cylinder, said control unit comprising a first pedal for providing a lifting motion to the primary carriage and a second pedal for providing a lowering motion to the primary carriage.

7. A wheeled transfer unit as recited in claim 6, wherein the control unit comprises a fluid reservoir and valving means operatively connected to the reservoir and said first and second pedals.

8. A wheeled transfer unit as recited in claim 2, wherein each of the clamping arms comprises:

(a) a housing, and (b) a pair of parallel pinch bars mounted in the housing for movement toward and away from each other.

9. A wheeled transfer unit as recited in claim 8, wherein the clamping arms are rotatably mounted on the support arms and each of said clamping arms, comprises:

(a) means for rotating the arm, and (b) means for locking the arm in a plurality of positions along its path of rotation.

10. A wheeled transfer unit as recited in claim 9, wherein the means for locking the clamping arm comprises:

(a) a disc mounted at one end of the bar adjacent the support arm and lying in a plane transverse to the axis of rotation of the bar, said disc having a plurality of spaced openings along a circle generated about the axis of rotation of the clamping arm, (b) latching means on the support arm, said latching means including a sliding bolt extending transversely of the plane of the disc, the longitudinal axis of said bolt intersecting said circle, so that the bolt can be slid into whichever one of the openings in said disc that is aligned with the aperture.

11. A wheeled transfer unit as recited in claim 10, wherein the means for rotating the clamping arm comprises a plurality of spaced holes along the outer periphery of the disc for insertion of an appropriate tool to provide leverage for rotating the disc.

* * * * *